US006886658B1

(12) United States Patent
Rolph

(10) Patent No.: US 6,886,658 B1
(45) Date of Patent: May 3, 2005

(54) LOUDSPEAKER ENCLOSURE SYSTEM

(76) Inventor: Prince John Charles Rolph, Coolcumbooka Estate, Cathcart, New South Wales (AU), 2623

( * ) Notice: Subject to any disclaimer, the term of this patent is extended or adjusted under 35 U.S.C. 154(b) by 0 days.

(21) Appl. No.: 10/275,416

(22) PCT Filed: Jul. 6, 2000

(86) PCT No.: PCT/AU00/00816

§ 371 (c)(1),
(2), (4) Date: Nov. 1, 2002

(87) PCT Pub. No.: WO01/91510

PCT Pub. Date: Nov. 29, 2001

(30) Foreign Application Priority Data

May 23, 2000 (AU) ..... PQ7675

(51) Int. Cl.[7] ..... A47B 81/06

(52) U.S. Cl. ..... 181/199; 181/148; 181/151; 181/155; 181/156

(58) Field of Search ..... 181/199, 148, 181/151, 155, 156

(56) References Cited

U.S. PATENT DOCUMENTS 4,008,374 A 2/1977 Tiefenbrun
4,213,008 A * 7/1980 Helffrich ..... 381/89
5,430,260 A * 7/1995 Koura et al. ..... 181/144
5,514,841 A * 5/1996 Rochon ..... 181/156

FOREIGN PATENT DOCUMENTS

| | | |
|---|---|---|
| DE | 3740643 A1 | 12/1987 |
| DE | 29804231 U1 | 3/1998 |
| EP | 0188295 | 7/1986 |
| FR | 2663181 | 12/1991 |
| GB | 2256344 | 12/1992 |
| JP | 09187091 | 12/1995 |

* cited by examiner

*Primary Examiner*—Shih-Yung Hsieh

(57) ABSTRACT

The system consists of 2 large speakers (1A & 1B), and 2 small full range speakers (2A & 2B) having about half the active cone area as the large speakers, mounted in a dual chamber enclosure (3) with the large speaker (1A) mounted on an internal baffle (4) forming a partition for a large bass reflex chamber (3A), with the large speaker (1B) mounted in common direction thereto immediately in front thereof together with the 2 smaller speakers (2A & 2B) mounted adjacent thereto on a front baffle (7) forming a small tympanic chamber (3B) by and with the large speakers (1A & 1B) and small speaker (2B) electrically connected to operate in common acoustic phase to each other with the other small speaker (2A) connected to operate in opposing phase thereto.

4 Claims, 3 Drawing Sheets

LOUDSPEAKER ENCLOSURE SYSTEM

TECHNICAL FIELD

This invention relates to and for the improvement of audio sound reproduction by conventional dynamic loudspeakers relevant to any given loudspeaker enclosure volume and related electrical power consumption, and in particular concerning the efficient and effective extension and reproduction of the lower audio frequencies, with a subsequent reduction in distortion together with an improvement in the transient response at such frequencies.

BACKGROUND TO THE INVENTION

It has long been difficult to accurately and efficiently reproduce the lower frequencies of the audio spectrum by traditionally adopted loudspeaker enclosures without the application of large volume speaker enclosures, or smaller enclosures requiring high electrical power consumption with respective high power capacity speakers.

SUMMARY OF THE INVENTION

These difficulties are somewhat overcome by the current invention of which adopts in reverse function the principle of biological transmission and reception of sound by and with a tympanic cavity or middle ear, in that there is a stage in the process of the system for the transmission and propagation of sound by and with the assistance of a tympanic chamber, that is a controlled pressure cavity or chamber to dampen and limit any distortion from being produced by the loudspeakers employed in the enclosure in the propagation of the low to middle audio frequencies, by and with a specified sum of opposing acoustic phasing of such frequencies within a specified cavity or chamber of the enclosure.

In one form of the invention the loudspeaker enclosure system consists of a number of open back dynamic loudspeakers, and may consist of at least four speakers with two large speakers and two small speakers having in total about half the active cone area as the large speakers employed, which are mounted in a dual chamber enclosure with one of the large speakers mounted within the enclosure on an internal baffle forming a partition for a large acoustic suspension or bass reflex chamber, with the other large speaker mounted in common direction thereto immediately in front thereof together with the two smaller speakers mounted adjacent and near thereto on a front baffle forming a small tympanic chamber of the enclosure, with the two large speakers and one only of the small speakers being electrically connected in common phase to each other and the other small speaker connected in opposing electrical phase thereto.

In other forms of the invention the loudspeaker enclosure system may incorporate any number of large speakers of the low and or to medium and or to the full audio frequency range, with any necessary electrical circuitry of medium to or high audio frequency attenuation, together with about the same-number of smaller or other speakers employed to total as near as possible the same active cone area as half the number of larger speakers employed, which may be of the full audio frequency range, or of the low and or to medium audio frequency range, and electrically coupled with any necessary crossover network therefore to a suitable number of high audio frequency range speakers independently enclosed adjacent or near to the small or other speakers employed; with half the number of smaller or other speakers connected in common electrical or acoustic phase with all the large speakers employed, and the other half number of the smaller or other speakers connected in opposing phase thereto.

The dual chamber loudspeaker enclosure of the system should preferably be constructed so as to reduce as much as practicable its any audio frequency resonances, with the larger acoustic suspension or bass reflex chamber enclosing half the number of large speakers employed, being of an internal volume according to the general parameters for and with the particular speakers so employed and enclosed. The smaller tympanic chamber of the enclosure should preferably be of sufficient internal volume to accommodate the half number of large speakers and such relevant number of smaller or other speakers employed, with any cross-section area of the chamber being equal to not less than the total active cone area of the smaller speakers mounted therein. Both chambers of the enclosure should preferably be adequately lined internally with an appropriate acoustic absorption material to limit internal chamber resonances.

The speakers or a number thereof mounted on the front baffle of the enclosure may be respectively inclined to some degree in opposing directions of each other to provide for or improve the distribution of monophonic or bi-channel stereophonic or surround sound propagation from the enclosure.

The large and small speakers employed in the enclosure should preferably be as near as possible of similar cone compliance and sensitivity with the same impedance; or be so electrically connected so as to provide as near as possible the same respective impedance as between the total of large and the total of small speakers employed. The small speakers employed should preferably have as near as possible in total about half the active cone area as the total of large speakers employed, and preferably have not less than half the power capacity in watts as the larger speakers employed.

DESCRIPTION OF THE FIGURE

To assist with an understanding of the invention example drawings of specific applications of the tympanic technology of the loudspeaker enclosure system are described with reference to the accompanying respective figures of common constituent part reference numbers.

DETAILED DESCRIPTION

Figure 1:
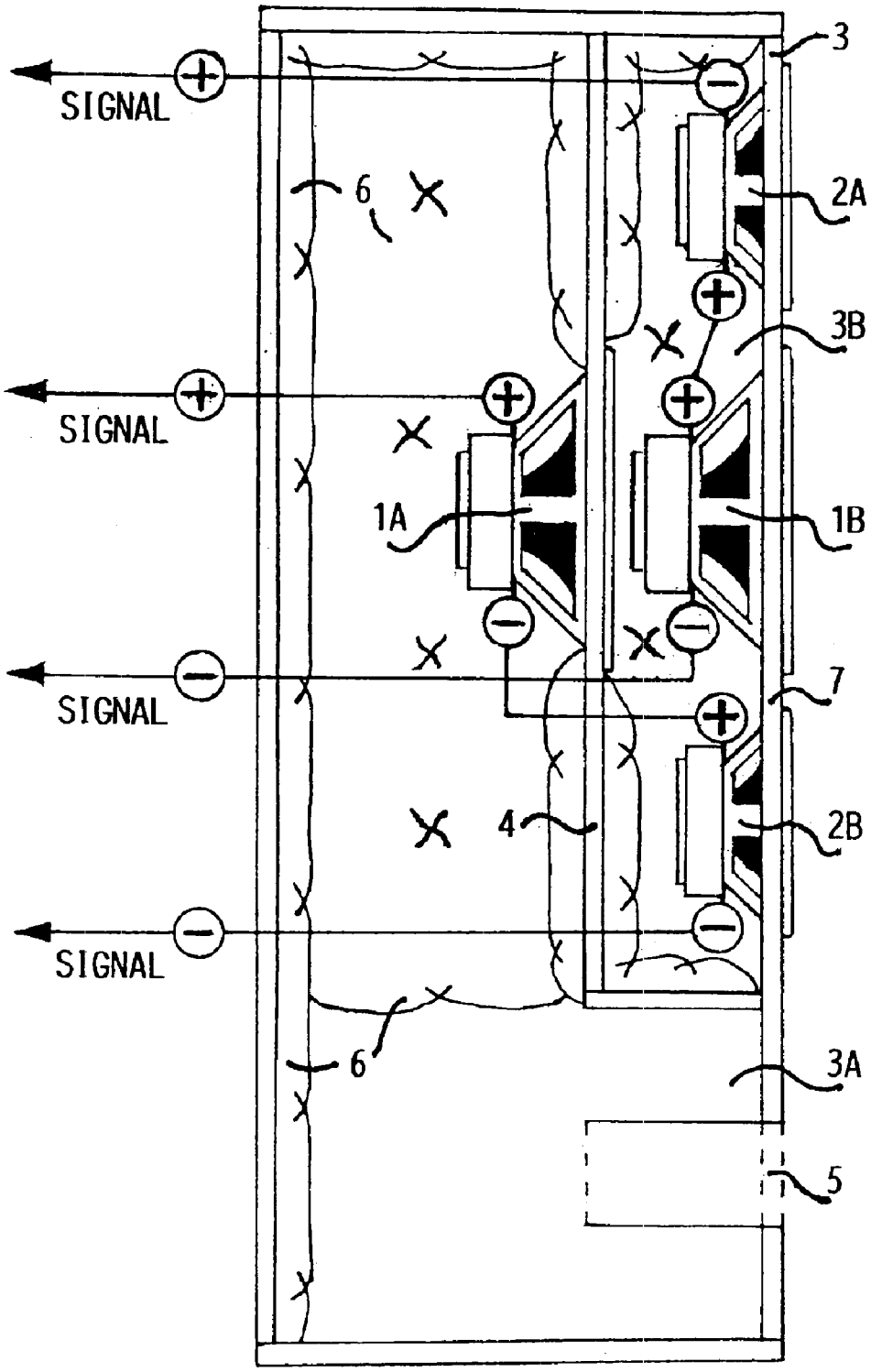
FIG. 1 is a side sectional elevation of the loudspeaker enclosure system consisting of at least four conventional open back dynamic loudspeakers.

With reference to FIG. 1 this example consists of two identical large speakers of low to middle audio frequency range. (1A & 1B), together with two identical smaller speakers of full audio frequency range (2A & 2B), having about half the active cone area as the larger speakers (1A & 1B). The speakers are mounted within a dual chamber enclosure (3). The large speaker (1A) is mounted within the enclosure on an internal baffle (4) which forms a partition for a large bass reflex chamber (3A) with a tuned vent or port area (5), and is internally lined with acoustic absorption material (6). The large speaker (1B) is mounted in common direction with the large speaker (1A) immediately in front thereof on a front baffle (7) which forms a smaller tympanic chamber (3B) of the enclosure, and is also lined internally with acoustic absorption material (6). The two smaller speakers (2A & 2B) are also mounted in common direction adjacent and near to the large speaker (1B) in the tympanic chamber (3B) of the enclosure (3).

The large speakers (1A & 1B) and the small speaker (2B) are electrically connected in common phase to each other, with the other small speaker (2A) being connected in opposing electrical phase thereto. The speakers are respectively terminated in pairs at suitable connectors at the rear of the enclosure (3) to provide for alternative impedance or connection for monophonic or bi-channel stereophonic or surround sound applications. When activated by an appropriate electrical audio signal the speakers (1A,1B,2A & 2B) and chambers (3A&–3B) of the enclosure (3) react with and upon each other in such a manner so as to effectively dampen and control and to efficiently reinforce and propagate the reproduction of sound over a broad audio frequency range with minimum distortion and maximum transient response.

Figure 2:
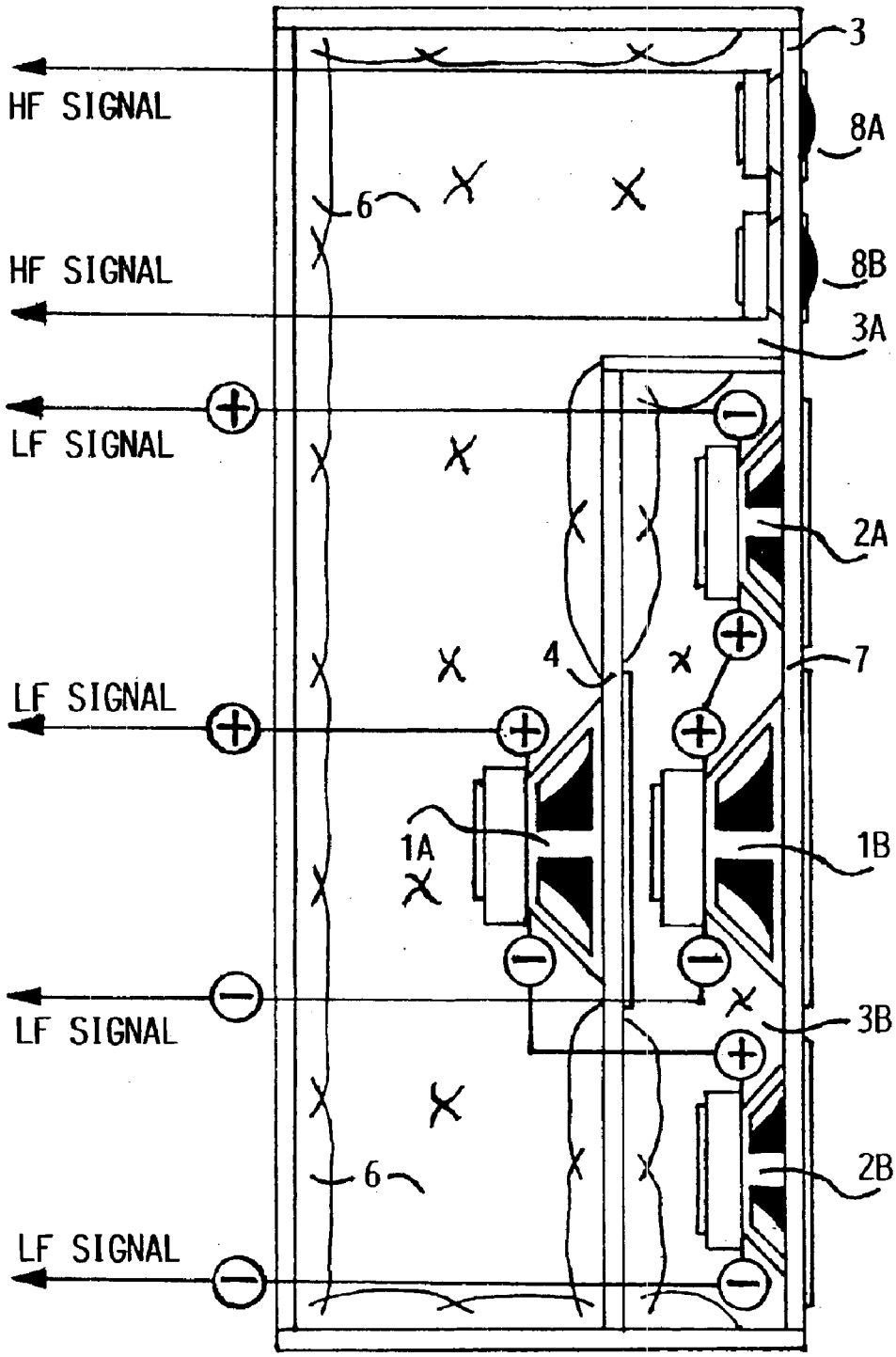
FIG. 2 is a side sectional elevation of the loudspeaker enclosure system consisting of at least four conventional open back dynamic loudspeakers, and two additional independently enclosed high audio frequency range loudspeakers of conventional closed back basket frame construction, mounted on the front baffle board of the enclosure to assist with and provide for the propagation of the high audio frequencies only from the enclosure.

With reference to FIG. 2 this example consists of two identical large speakers of the low audio frequency range 1A and 1B, and two identical smaller speakers of the low to medium audio frequency range 2A and 2B having about half the active cone area as the large speakers 1A and 1B. The speakers are mounted within a dual chamber enclosure 3. The large speaker 1A is mounted within the enclosure on an internal baffle 4 which forms a partition for a large acoustic suspension chamber 3A and is internally lined with acoustic absorption material 6. The large speaker 1B is mounted in common direction with the large speaker 1A immediately in front thereof on a front baffle 7, which forms a smaller tympanic chamber 3B of the enclosure, and is also lined internally with acoustic absorption material 6. The two smaller speakers 2A and 2B are also mounted in common direction adjacent and near to the large speaker 1B in the tympanic chamber 3B of the enclosure 3. The large speakers 1A and 1B and the small speaker 2B are electrically connected in common phase to each other, with the other small speaker 2A being connected in opposing electrical phase thereto. The speakers are respectively terminated in pairs at suitable connectors at the rear of the enclosure 3 to provide for alternative impedance or connection for monophonic or bi-channel stereophonic or surround sound applications. In addition to the speakers referred to above for the propagation of the low and medium audio frequencies from the enclosure 3, two identical independently enclosed high audio frequency range loudspeakers 8A and 8B, and also mounted on the front baffle 7, are also respectively terminated with suitable connectors at the rear of the enclosure 3, to assist with and provide for the propagation of the higher audio frequencies only from the enclosure 3.

Figure 3:
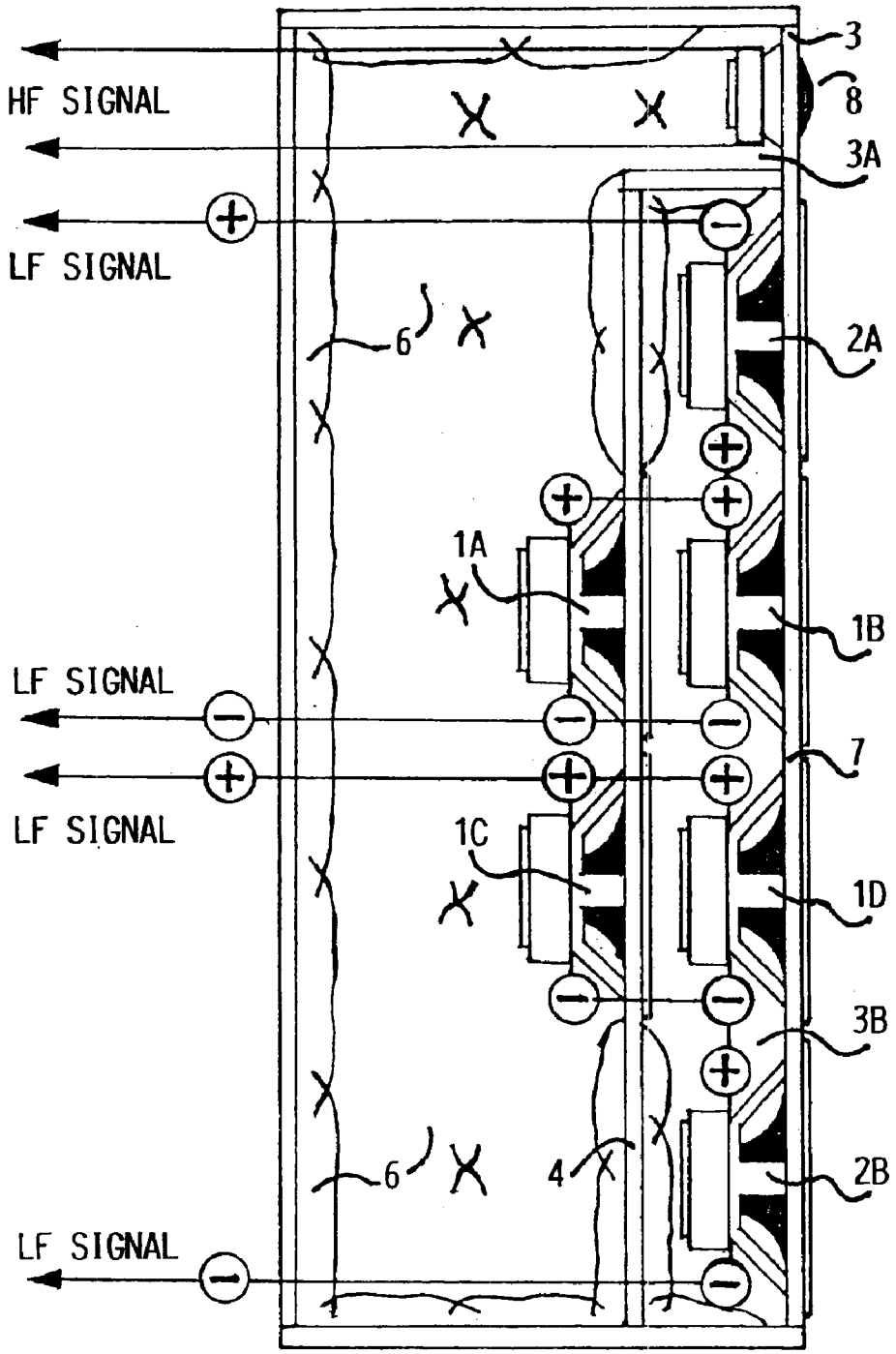
FIG. 3 is a side sectional elevation of the loudspeaker enclosure system consisting of more than four conventional open back dynamic loudspeakers, with an additional independently enclosed high audio frequency range loudspeaker of conventional closed back basket frame construction, mounted on the front baffle board of the enclosure to assist with and provide for the propagation of the high audio frequencies only from the enclosure.

With reference to FIG. 3, this example consists of more than four loudspeakers with six speakers each having the same active cone area, with four of such speakers 1A, 1B, 1C and 1D of low audio frequency range, and the other two speakers 2A and 2B of the low and to medium audio frequency range with a total active cone area equal to about one-half range the total active cone area of speakers 1A, 1B, 1C and 1D. The speakers are mounted within a dual chamber enclosure 3, with speakers 1A and 1C mounted within the enclosure on an internal baffle 4, which forms a partition for a large acoustic suspension chamber 3A, which is internally lined with an acoustic absorption material 6. The speakers 1B and 1D are respectively mounted in common direction to speakers 1A and 1C immediately in front of each other on a front baffle 7, which forms a smaller tympanic chamber of the enclosure 3B, and is also lined internally with an acoustic absorption material 6. The speakers 2A and 2B are also respectively mounted in common direction of and near to the speakers 1B and 1D on the front baffle 7 of the tympanic chamber 3B of the enclosure 3. The speakers 1A, 1B, 1C, 1D and 2B are electrically connected in common phase to each other, with speaker 2A connected in opposing electrical phase thereto. The speakers are respectively terminated in pairs at suitable connectors at the rear of the enclosure 3, to provide for alternative impedance connection or for monophonic or bi-channel stereophonic or surround sound applications. In addition to the speakers referred to above for the propagation of the low and medium audio frequencies from the enclosure 3, an independently enclosed high audio frequency range loudspeaker 8 is also mounted on the front baffle 7, and is respectively terminated with suitable connectors at the rear of the enclosure 3, to assist with and provide for the propagation of the higher audio frequencies only from the enclosure 3.

In accordance with the other examples of this invention, respectively described and referred to in FIG. 1 and FIG. 2, when activated by an appropriate positive charge of electrical audio signal the respective cones of speakers 1A, 1B, 1C, 1D and 2B move in common direction of each other towards the front of the enclosure 3; and with respect to speakers 1A and 1C mounted on the internal baffle 4, effectively drive and force the air captivated by their respective cones into and towards the rear of speakers 1B and 1D mounted on the front baffle 7 of the tympanic chamber 3B; at the same instant of time the respective cones of speakers 1B, 1D and 2B effectively drive and propagate the air captivated by their respective cones from the enclosure 3, with speakers 1B and 1D effectively displacing the sum of driven and forced air from the cones of speakers 1A and 1C; and with the cone of speaker 2A being electrically connected in opposing phase thereto at the same instant of time driving and forcing the air captivated by its respective cone in the opposite direction thereto into and towards the tympanic chamber 3B of the enclosure 3, at an equal sum of displacement of air as is driven and dispersed from the enclosure 3 by speaker 2B; thus providing an equal sum of displacement of the air contained within the tympanic chamber 3B, with and at any alternate electrical charge driven movements of the respective cones of the speakers so connected and contained within and for the operation of the tympanic chamber 3B, upon any given instance of applied audio signal thereto.

With the loudspeaker enclosure system providing a ratio sum of about five to one of acoustic feedback to the tympanic chamber 3B, by the opposite electrical phase connection of speaker 2A, the tympanic chamber will effectively react to and function with any portion of an electrical audio frequency signal when applied to the speakers engaged in and forming the tympanic chamber 3B, equal to and from about one quarter of an audio frequency wavelength or more as determined by the mean physical distance fixed between the speakers 1B and 2A mounted on the front baffle 7 of the enclosure 3; for reason of the progressive reduction of acoustic phase shift cancellation effects proportional to the reduction in audio frequency applied to the speakers engaged in and forming the tympanic chamber 3B, thus providing a proportional sum of acoustic dampening of the respective speaker cones engaged in the tympanic chamber 3B at such frequencies, assisting to reduce any distortion of and from the respective cones of the speakers so engaged and further providing for the more efficient function and extension of the lower audio frequency capacities of the respective speakers so employed; with the transient response of such speakers so engaged also increased by the assisted acceleration of their respective driven cone movements, by and with the reciprocating cross-action harmonic acoustic forces provided for between the cones of the respective speakers 2A and 2B, of opposing acoustic phase and common air displacement capacity, upon the respective cones of speakers 1A, 1B, 1C and 1D of common acoustic phase and of neutral air displacement capacity within the tympanic chamber 3B of the enclosure 3.

What is claimed is:

1. A loudspeaker enclosure system consisting of at least four speakers with two large low or full audio frequency range speakers and two small full audio frequency range speakers having in total about half the active cone area as the large speakers employed, which are mounted in a dual chamber enclosure with one of the large speakers mounted within the enclosure on an internal baffle forming a partition for a large acoustic suspension or bass reflex chamber, with the other large speaker mounted in common direction thereto immediately in front thereof together with the two smaller speakers mounted adjacent and near thereto on a front baffle forming a small tympanic chamber of the enclosure by and with the two large speakers and one only of the small speakers being electrically connected to operate in common acoustic phase to each other with the other small speaker electrically connected to operate in opposing phase thereto.

2. A loudspeaker enclosure system of claim 1 hereof consisting of more than four open back dynamic loudspeakers.

3. A loudspeaker enclosure system of claim 2 hereof with additional high audio frequency range loudspeakers independently enclosed and mounted in or near to either chamber of the enclosure and electrically connected with any necessary crossover network to operate and propagate the high audio frequencies from the enclosure.

4. A loudspeaker enclosure system of claim 1 hereof with additional high audio frequency range loudspeakers independently enclosed and mounted in or near to either chamber of the enclosure and electrically connected with any necessary crossover network to operate and propagate the high audio frequencies from the enclosure.

* * * * *